US006581515B1

(12) United States Patent
Hasebe

(10) Patent No.: US 6,581,515 B1
(45) Date of Patent: Jun. 24, 2003

(54) STENCIL PRINTING METHOD AND STENCIL PRINTER THEREFOR

(75) Inventor: Daisuke Hasebe, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 39 days.

(21) Appl. No.: 09/604,911

(22) Filed: Jun. 28, 2000

(30) Foreign Application Priority Data

Jun. 29, 1999 (JP) ..... 11-183189

(51) Int. Cl.[7] ..... B41L 13/00
(52) U.S. Cl. ..... 101/119; 101/115
(58) Field of Search ..... 101/114, 115, 101/116, 119, 120, 129

(56) References Cited

U.S. PATENT DOCUMENTS 6,067,902 A 5/2000 Takahashi

FOREIGN PATENT DOCUMENTS

| | | |
|---|---|---|
| GB | 2 277 904 | 11/1994 |
| JP | 1-290489 | 11/1989 |
| JP | 3-55276 | 3/1991 |
| JP | 6-32038 | 2/1994 |
| JP | 7-17121 | 1/1995 |
| JP | 10-297073 | 11/1998 |
| JP | 10-305649 | 11/1998 |
| JP | 11-34467 | 2/1999 |

*Primary Examiner*—Ren Yan
(74) *Attorney, Agent, or Firm*—Oblon, Spivak, McClelland, Maier & Neustadt, P.C.

(57) ABSTRACT

A stencil printing method of the present invention intentionally transfers a smaller amount of ink from an upstream print drum to a paper sheet than from a downstream print drum to the same paper sheet such that images printed on the paper sheet one above the other have the same density at the end of a printing cycle. The method obviates a density difference and the roll-up of a paper sheet ascribable to retransfer particular to a single pass, color printing system. A stencil printer for practicing the method is also disclosed.

5 Claims, 13 Drawing Sheets

STENCIL PRINTING METHOD AND STENCIL PRINTER THEREFOR

BACKGROUND OF THE INVENTION

The present invention relates to a stencil printing method for printing a color image on a sheet by conveying the paper sheet only once and a stencil printer for practicing the same.

It is a common practice with a stencil printer to arrange a plurality of print drums each being assigned to a particular color in a direction in which a paper is conveyed. While a paper sheet is conveyed only once, ink images of different colors are sequentially transferred from the print drums to the paper sheet one above the other, forming a composite color image. Such a single pass, color printing system is far more efficient than a system that requires a print drum to be replaced color by color and repeatedly feeds the same paper sheet. This kind of system, however, has some problems left unsolved due to a short interval between consecutive printing positions. Specifically, so-called retransfer repeatedly occurs in this kind of system on the second and successive paper sheets. A density difference between the first and second colors sequentially increases and degrades image equality.

Further, an increase in the density of an ink image of the first color directly translates into an increase in the adhering force of ink forming the image. The ink is therefore apt to prevent a paper sheet from being separated from a print drum assigned to the second color and cause it to roll up together with the print drum being rotated.

Technologies relating to the present invention are disclosed in, e.g., Japanese Patent Laid-Open Publication Nos. 1-290489, 3-55276, 6-32038, 7-17121, 10-297073, 10-305649 and 11-34467, and GB 2,277,904A.

SUMMARY OF THE INVENTION

It is therefore an object of the present invention to provide a stencil printing method capable of obviating a density difference and the roll-up of a paper sheet ascribable to retransfer and a stencil printer for practicing the same.

In accordance with the present invention, in a stencil printing method for printing a color image on a paper sheet by passing a paper sheet only once through a stencil printer in which a plurality of print drums each having a respective master wrapped therearound are spaced from each other in a direction of paper conveyance, ink is transferred from an upstream print drum, in the above direction, to the paper sheet in a smaller amount than ink transferred from a downstream print drum to the same paper sheet such that the former ink is equal in amount to the latter ink at the end of a printing cycle.

Also, in accordance with the present invention, a stencil printer for printing a color image on a paper sheet by passing the paper sheet only once therethrough includes a plurality of print drums each having a respective master wrapped therearound and spaced from each other in a direction of paper conveyance. An ink transfer adjusting device causes ink to be transferred from an upstream print drum, in the above direction, to the paper sheet in a smaller amount than ink transferred from a downstream print drum to the same paper sheet such that the former ink is equal in amount to the latter ink at the end of a printing cycle.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
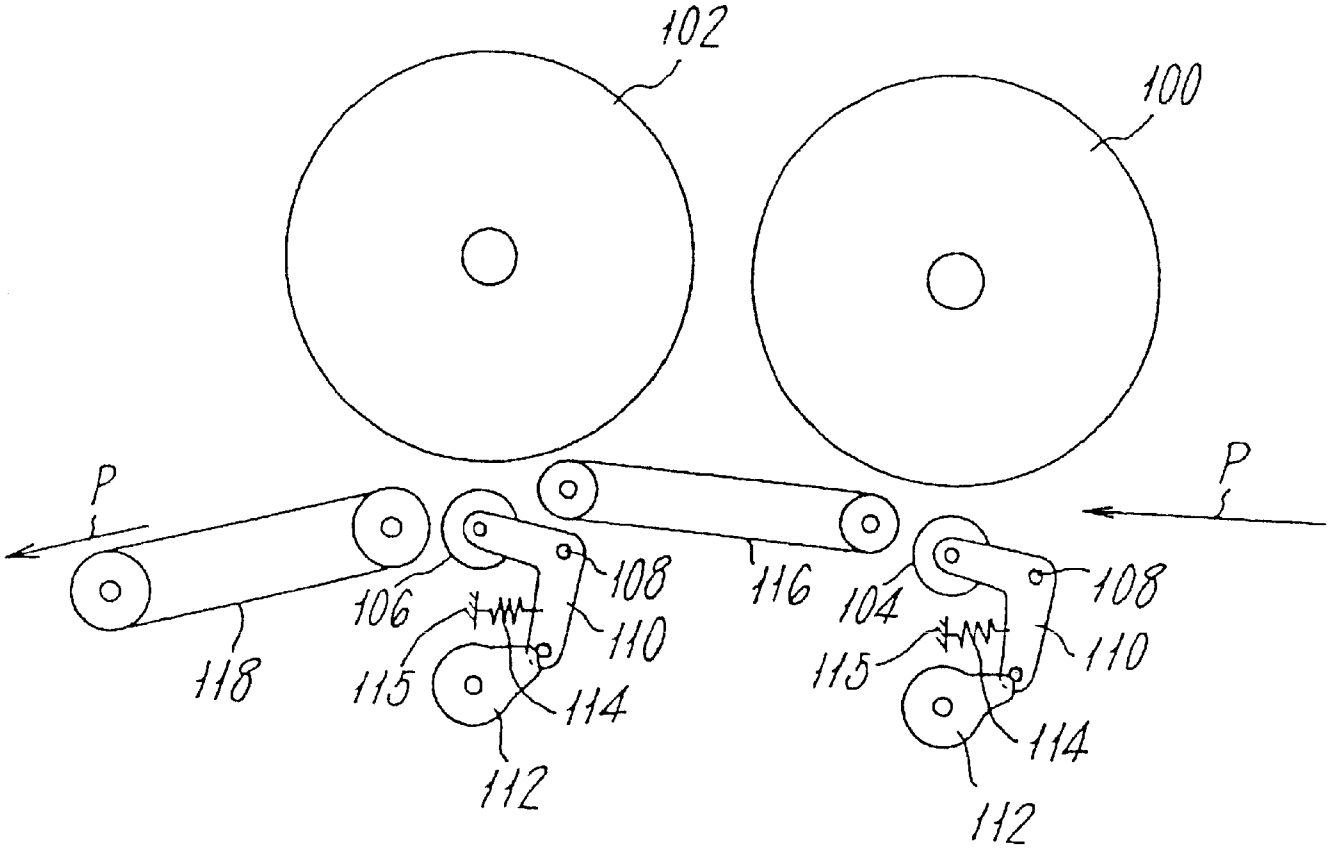
FIG. 1 PRIOR ART
FIG. 1 is a front view showing a conventional stencil printer.

To better understand the present invention, brief reference will be made to a conventional single pass, color stencil printer, shown in FIG. 1. As shown, the printer includes two print drums 100 and 102 spaced from each other in a direction in which a paper sheet P is conveyed. The print drums 100 and 102 are assigned to a first color and a second color, respectively.

A press roller 104 is positioned below the print drum 100 for pressing the paper sheet P against the print drum 100. An arm 110 is rotatable about a shaft 108 and rotatably supports the press roller 104 at one end thereof. A spring 114 is anchored at one end to the other end of the arm 110 and at the other end to a stationary member 115 forming part of the printer body. The spring 114 constantly biases the arm 110 such that the above other end of the arm 110 contacts a cam 112. The cam 112 causes the press roller 104 to selectively move into or out of contact with the print drum 100 via the arm 110. The press roller 104 forms a nip between it and the print drum 100 when contacting the print drum 100, thereby pressing the paper sheet P against the print drum 100 with a preselected pressure.

A press roller 106 is positioned below the other print drum 102. A shaft 108, an arm 110, a cam 112 and a spring 114 are associated with the press roller 106 in the same manner as the shaft 108, arm 110, cam 112 and spring 114 assigned to the print drum 100.

In this manner, the press rollers 104 and 106 are moved about the respective shafts 108 by identical mechanisms so as to exert the same pressure on the drums 100 and 102, respectively.

Ink feeding means, not shown, is arranged within each of the print drums 100 and 102. The ink feeding means respectively feed ink of a first color and ink of a second color to the print drums 100 and 102. When the press roller 104 presses the paper sheet P against the print drum 100, the ink of the first color is transferred from the print drum 100 to the paper sheet P via perforations formed in a master that is wrapped around the print drum 100. Likewise, when the press roller 106 presses the paper sheet P against the print drum 102, the ink of the second color is transferred from the print drum 102 to the paper sheet P via a master wrapped around the print drum 102.

Peeling means, not shown, peels off the paper sheet P carrying the ink of the first color thereon from the print drum 100. Intermediate conveying means 116 conveys the paper sheet P peeled off to a nip between the print drum 102 and the press roller 106 while retaining it on a belt by air suction. After the ink of the second color has been transferred from the print drum 102 to the paper sheet P, another peeling means, not shown, peels off the paper sheet P. Subsequently, outlet conveying means 118 conveys the paper sheet P to a tray, not shown, while retaining it on a belt by air suction.

The above-described single-pass, color (bicolor) printing system is far more efficient than a system that requires a print drum to be replaced color by color and repeatedly feeds the same paper sheet. This kind of system, however, has some problems left unsolved due to a short interval between consecutive printing positions, as will be described hereinafter with reference to FIGS. 2 through 5.

Figure 2:
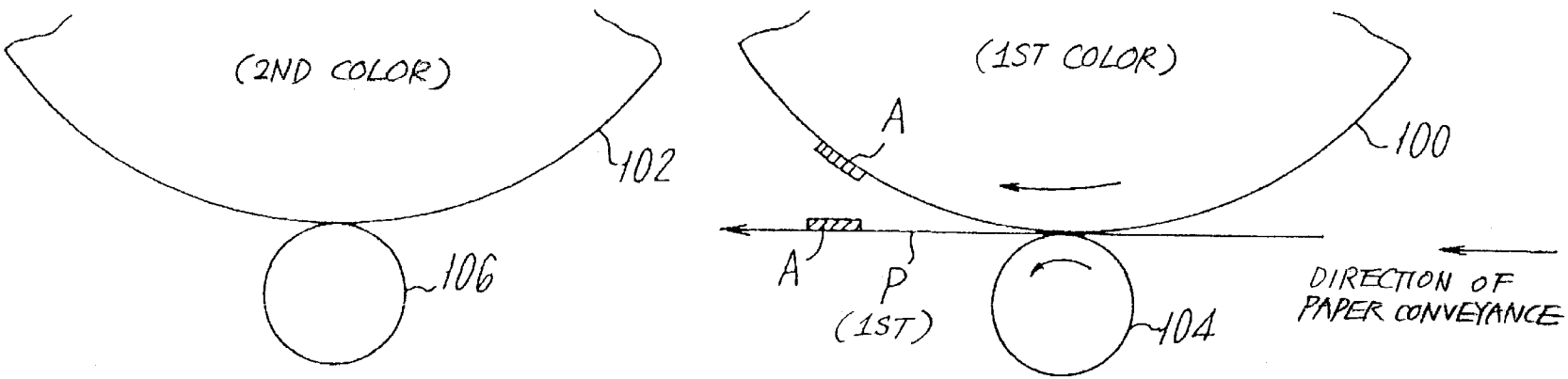
FIG. 2 PRIOR ART
FIGS. 2 through 5 are fragmentary views showing how the conventional stencil printer sequentially prints images of a first and a second color on a first and a second paper sheet.
Figure 3:
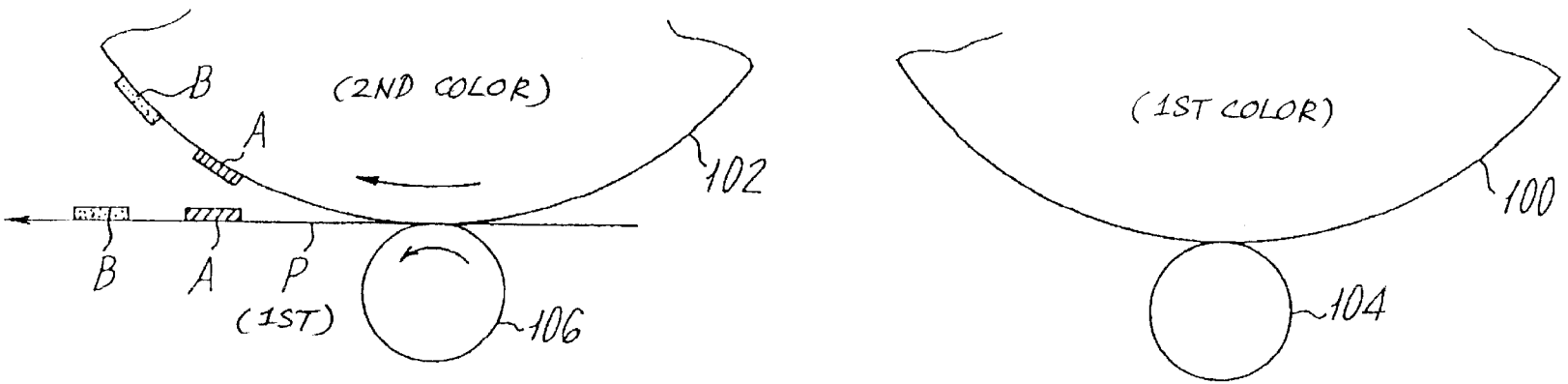
FIG. 3 PRIOR ART

As shown in FIG. 2, an ink image of the first color A is transferred from the print drum 100 to the first paper sheet P. Subsequently, as shown in FIG. 3, an ink image B of the second color is transferred from the print drum 102 to the same paper sheet P over the ink image A. However, because the ink image A arrives at the nip between the print drum 102 and the press roller 106 before it dries, part of the ink image A is transferred from the paper sheet P to a master, not shown, wrapped around the print drum 102. Consequently, the ink image A existing on the first paper sheet P is slightly lower in density than the ink image B formed on the same paper sheet P despite that the ink images A and B are transferred under identical conditions.

Figure 4:
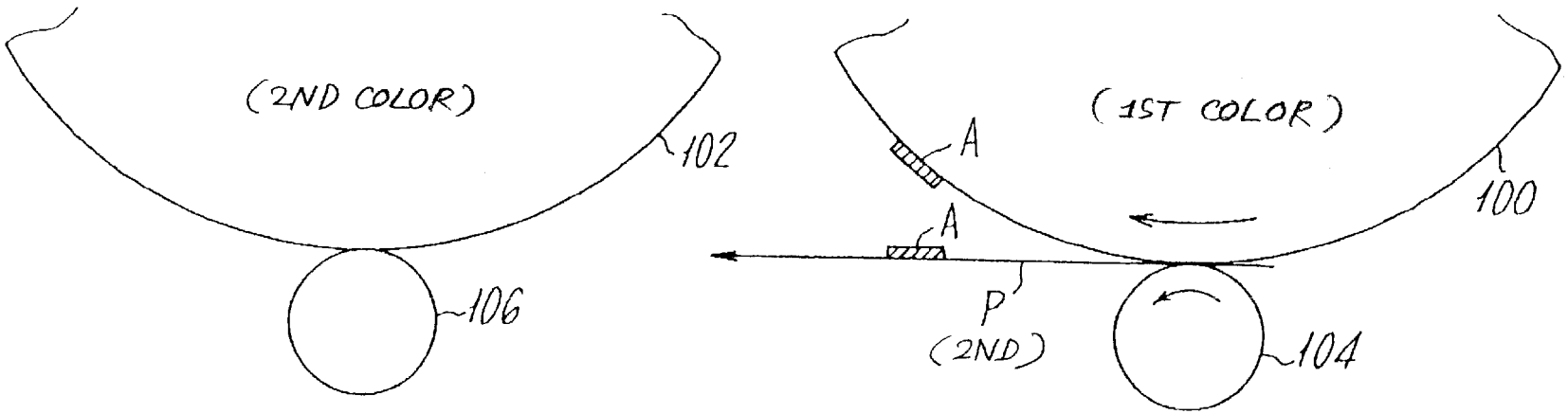
FIG. 4 PRIOR ART
Figure 5:
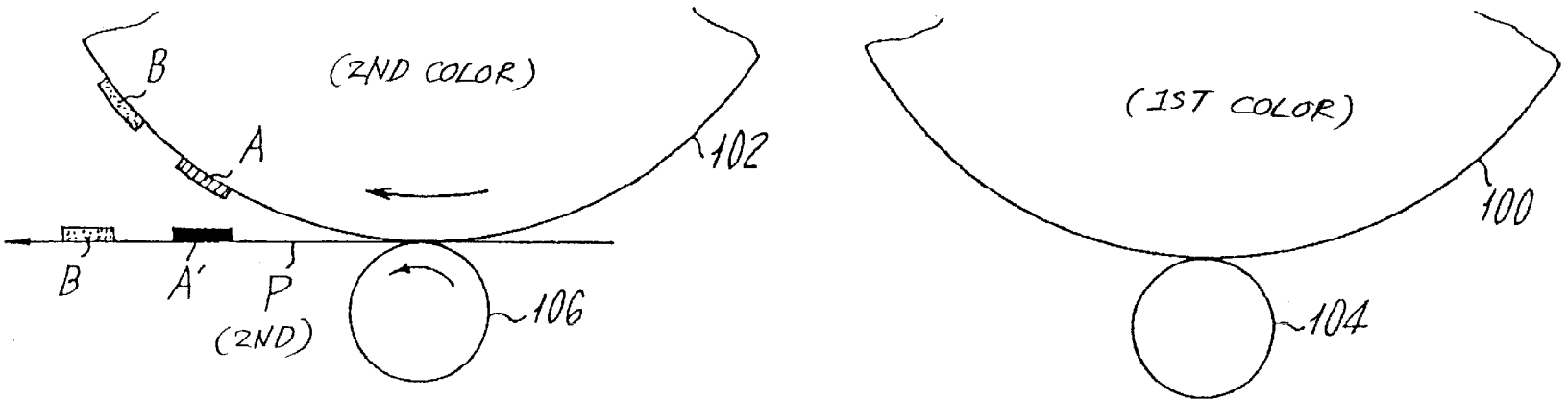
FIG. 5 PRIOR ART

As shown in FIG. 4, the second ink image A of the first color is transferred to the second paper sheet P in the same manner as the first ink image A has been transferred to the first paper sheet P. However, as shown in FIG. 5, when the second ink image B of the second color is transferred to the second paper sheet P over the second ink image A, the part of the first ink image A previously transferred to the master wrapped around the print drum 102 is again transferred to the second paper sheet P over the ink image A existing on the paper sheet P (generally referred to as retransfer). As a result, an ink image A' higher in density than the second ink image B is formed on the paper sheet P. Such retransfer repeatedly occurs on the third and successive paper sheets. The difference in density between the first and second colors degrades image density when it becomes noticeable.

Further, an increase in the density of the ink image A of the first color directly translates into an increase in the adhering force of the ink that forms the image A. The ink is therefore apt to prevent the paper sheet P from being separated from the print drum 102 and cause it to roll up together with the print drum 102 being rotated.

Figure 6:
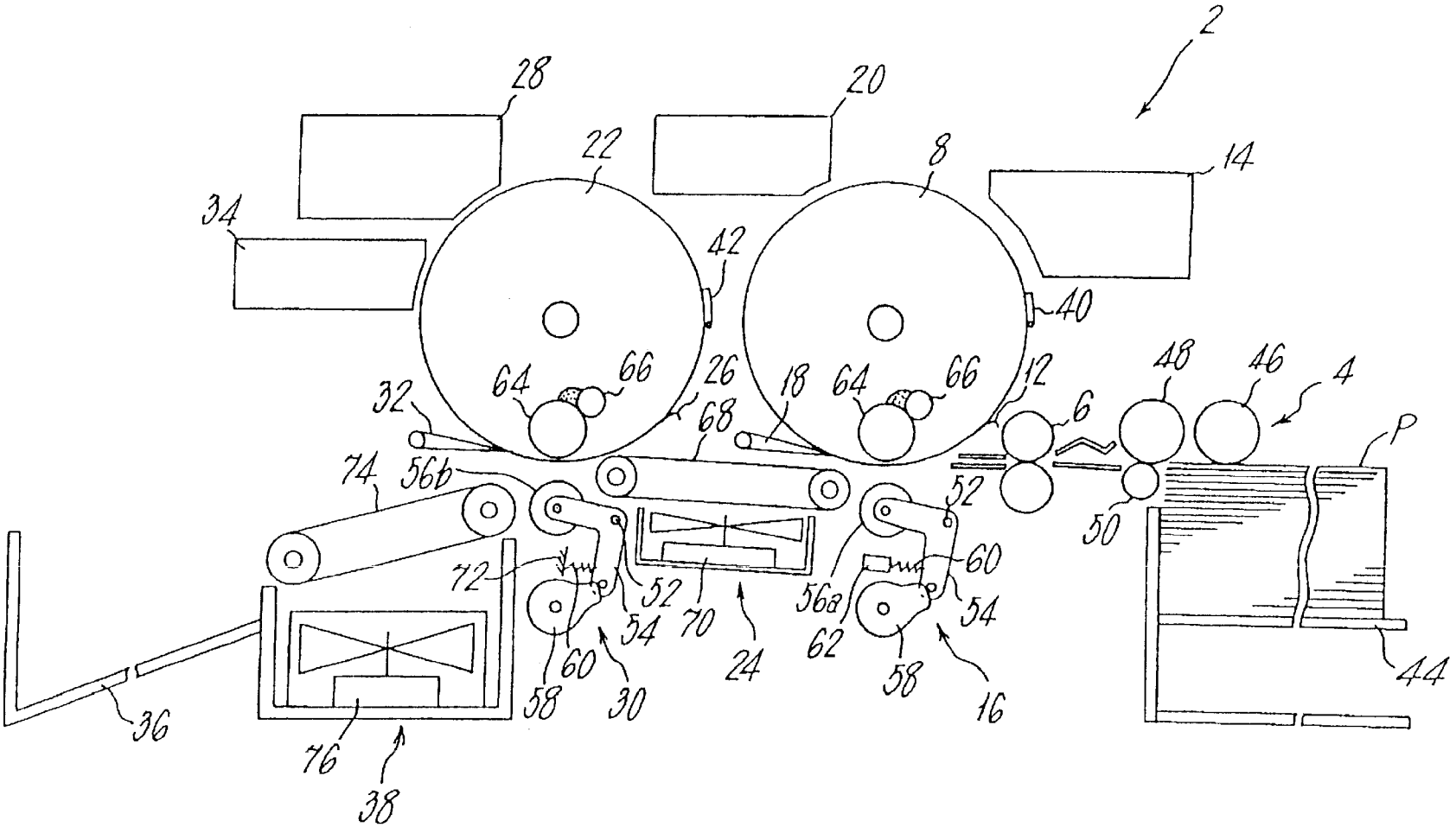
FIG. 6 is a front view showing a stencil printer embodying the present invention.

Referring to FIG. 6, a stencil printer embodying the present invention and implemented as a bicolor stencil printer by way of example will be described. As shown, the stencil printer, generally 2, includes paper feeding means 4 and a registration roller pair 6. Two print drums 8 and 22 are respectively positioned at an upstream side and a downstream side in a direction in which a paper sheet P is conveyed. The print drums 8 and 22 are assigned to a first color and a second color, respectively. Master making means 14 perforates, or cuts, a stencil in order to form a master 12 to be wrapped around the print drum 8. Pressing means 16 presses the paper sheet P against the print drum 8 with a preselected pressure. Air jet type peeling means 18 peels off the paper sheet P carrying an image of the first color from the print drum 8. Master discharging means 20 peels off the master 12 from the print drum 8 after the master 12 has been used. Intermediate conveying means 24 conveys the paper sheet P from the print drum 8 to the print drum 22 while retaining it on a belt by air suction.

Master making means 28 perforates a stencil in order to make a master 26 to be wrapped around the print drum 22. Pressing means 30 presses the paper sheet P against the print drum 22 with a preselected pressure. Air jet type peeling means 32 peels off the paper sheet P carrying an image of the second color from the print drum 22. Master discharging means 34 peels off the master 26 from the print drum 22 after the master 26 has been used. Outlet conveying means 38 conveys the paper sheet P separated from the print drum 22 to a tray 36. Master clampers 40 and 42 are mounted on the print drums 8 and 22, respectively.

The configuration of the print drums 8 and 22 and the procedure for making the masters 12 and 26 are well known in the art and will not be described specifically.

The paper feeding means 4 includes a paper tray 44 on which the paper sheets P are stacked. The paper tray 44 is resiliently biased upward. A pickup roller 46 and separator rollers 48 and 50 cooperate to pay out the top paper sheet P from the tray 44 toward the registration roller pair 6 while separating it from the underlying paper sheets P. The registration roller pair 6 corrects, e.g., the skew of the paper sheet P and then drives it toward the print drum 8 such that the leading edge of the paper sheet P meets the leading edge of an image existing on the print drum 8.

The pressing means 16 includes an arm 54 rotatably mounted on a shaft 52. A press roller **56*a* is rotatably supported by one end of the arm 54. A cam 58 is held in contact with the other end of the arm 58 for driving the arm 58. A spring 60 constantly biases the arm 54 such that the press roller 56*a* tends to contact the print drum 8. Pressure adjusting means 62 adjusts the biasing force of the spring 60**.

The press roller **56*a* is caused to contact the print drum 8 in synchronism with the feed of the paper sheet P from the paper feeding means 4, forming a nip between the press roller 56*a* and the print drum 8. Ink feeding means is arranged within the print drum 8 for feeding ink to the inner periphery of the print drum 8. The ink feeding means includes an ink roller 64 and a doctor roller 66. The pressure of the press roller 56*a* acting on the outer periphery of the print drum 8 causes the ink to be transferred to the paper sheet P via perforations formed in the master 12. As a result, an image is printed on the paper sheet P in the first color. The press roller 56*a* is intermittently brought into contact with the print drum 8 so as not to interfere with the master damper 40 mounted on the print drum 8**.

The peeling means 18 peels off the paper sheet P carrying the image of the first color thereon from the print drum 8. The intermediate conveying means 24 conveys the paper sheet P from the print drum 8 to a nip between the print drum 22 and the press roller **56*b*. The conveying means 24 has a conventional configuration including a belt 68 and a fan 70** and conveys the paper sheet P while retaining it thereon by air suction.

The pressing means 30 assigned to the print drum 22 is identical with the pressing means 16 except that one end of a spring 60 is anchored to a stationary member 72 forming part of the printer body. Therefore, the biasing force of this spring 60 is not adjustable, as in the conventional configuration.

The press roller **56*b* is caused to contact the print drum 22 in synchronism with the operation of the intermediate conveying means 24, forming a nip between the press roller 56*b*** and the print drum 22. Ink feeding means is arranged within the print drum 22 for feeding ink to the inner periphery of the print drum 22. The ink feeding means includes an ink roller 64 and a doctor roller 66. The pressure of the press roller 56*b* acting on the outer periphery of the print drum 22 causes the ink to be transferred to the paper sheet P via perforations formed in the master 26. As a result, an image is printed on the paper sheet P in the second color. The press roller 56*b* is intermittently brought into contact with the print drum 22 so as not to interfere with the master damper 42 mounted on the print drum 22.

The peeling means 32 peels off the paper sheet P carrying the image of the second color thereon from the print drum 22. Subsequently, the outlet conveying means 38 conveys the paper sheet P to the tray 36. The outlet conveying means 38, like the intermediate conveying means 24, has a conventional configuration including a belt 74 and fan 76 and conveys the paper sheet P while retaining it thereon by air suction.

Figure 7:
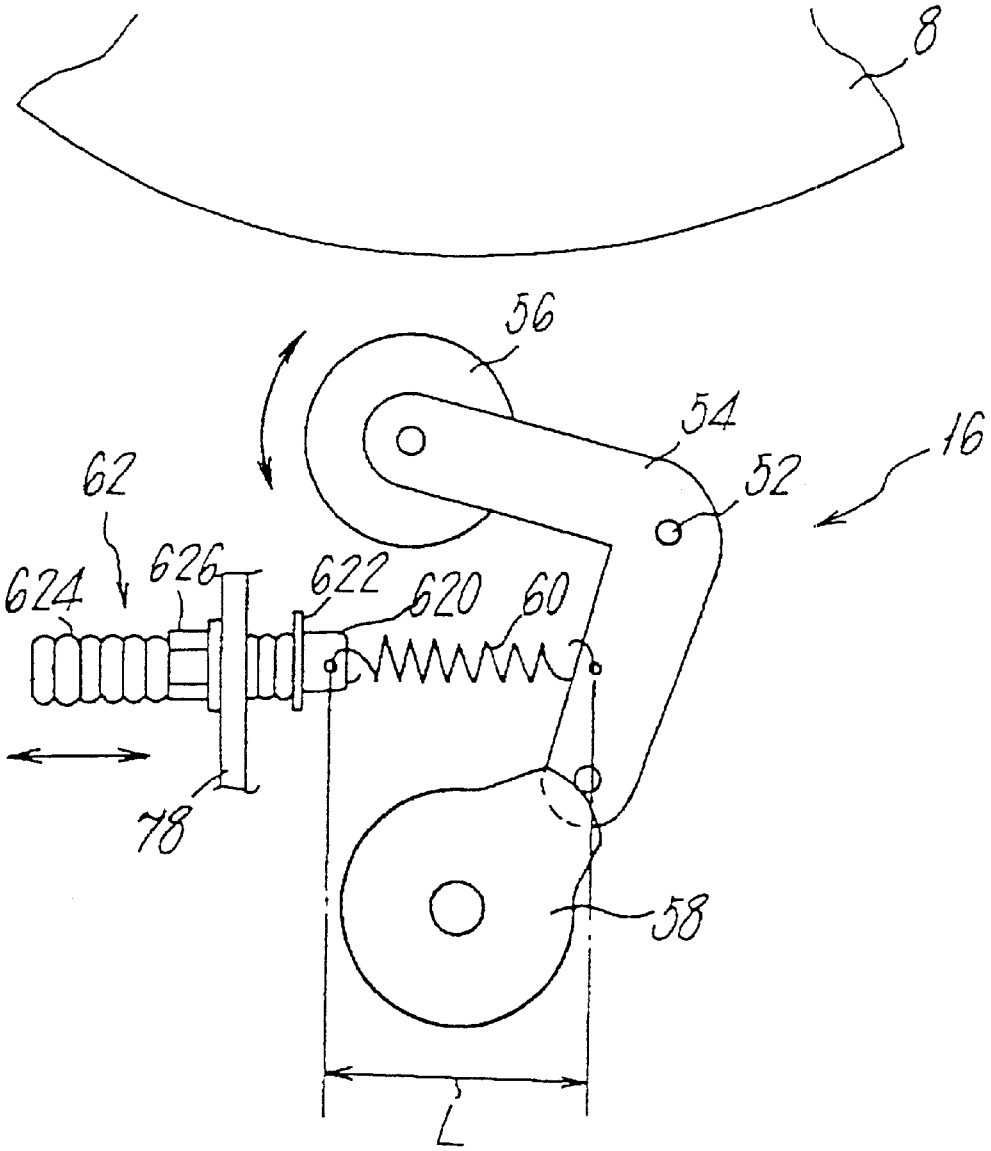
FIGS. 7 through 11 are fragmentary views showing how the illustrative embodiment sequentially prints images of a first and a second color on a first and a second paper sheet.

As shown in FIG. 7, the pressure adjusting means 62 includes a retaining portion 620 retaining one end of the spring 60. A stop portion 622 limits the amount of adjustment in the direction in which the spring 60 extends. A screw portion 624 is held in threaded engagement with a side wall 78 included in the printer body. A nut 626 is held in threaded engagement with the screw portion 624. The retaining portion 620, stop portion 622 and screw portion 624 are formed integrally with each other.

In the illustrative embodiment, the pressure of the upstream press roller 56*a* to act on the print drum 8 is selected to be lower than the pressure of the downstream press roller 56*b* to act on the print drum 2. Stated another way, the amount of the ink to be transferred from the print drum 8 to the paper sheet P is smaller than the amount of the ink to be transferred from the print drum 22 to the paper sheet P. More specifically, the spring 60 associated with the print drum 8 has a length L shorter than the length of the spring 60 associated with the print drum 22.

To adjust the biasing force of the spring 60, the nut 626 is turned to move the screw portion 624 in a direction indicated by a double-headed arrow, thereby varying the length of the spring 60. In this manner, the pressure adjusting means 62 implements stepless adjustment because of the screw scheme.

Figure 8:
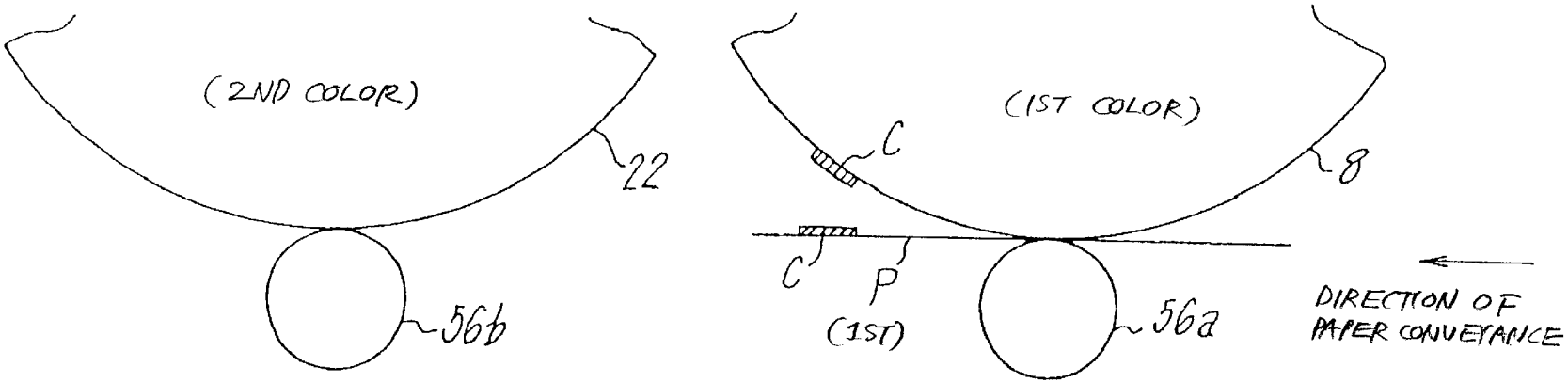
Figure 9:
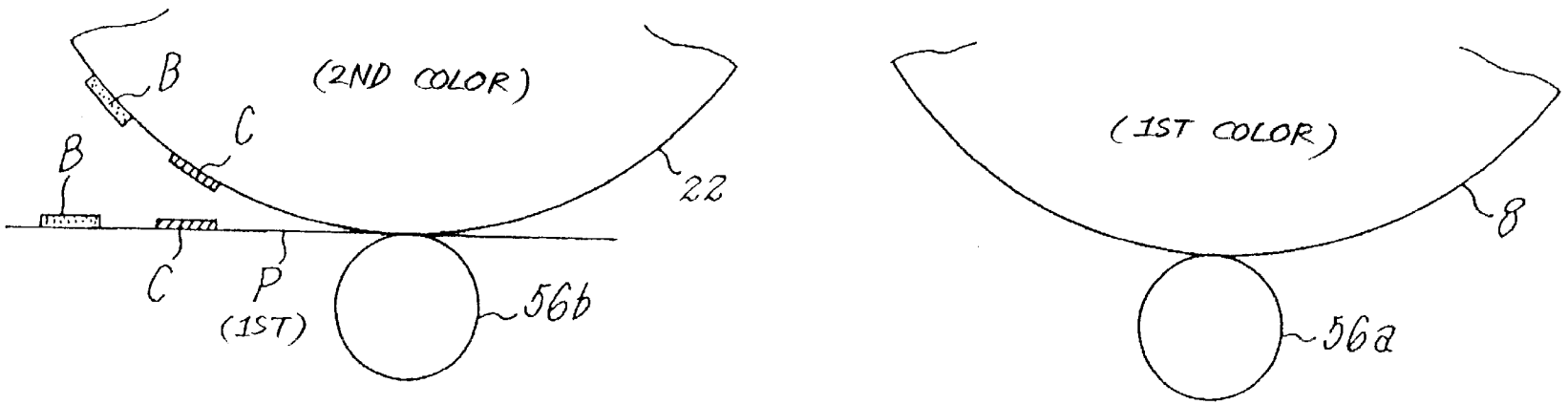

In operation, as shown in FIG. 8, an ink image C of the first color is transferred from the print drum 8 to the first paper sheet P. At this instant, the ink transferred from the print drum 8 to the paper sheet P is smaller in amount than the ink to be transferred from the print drum 22 to the same paper sheet P later because of the above-described relation between the pressures. That is, the image C is lower in density than an ink image B (see FIG. 9) of the second color to be formed on the paper sheet P later. Subsequently, as shown in FIG. 9, the image B is transferred from the print drum 22 to the paper sheet P brought to the nip between the print drum 22 and the press roller 56*b*.

The paper sheet P carrying the image C of the first color arrives at the nip between the print drum 22 and the press roller 56*b* before the ink forming the image C dries. The image C is therefore partly transferred from the paper sheet P to the master 26 existing on the print drum 22. Consequently, at the end of the first printing cycle, the image C has density further lower than the density of the image B.

Figure 10:
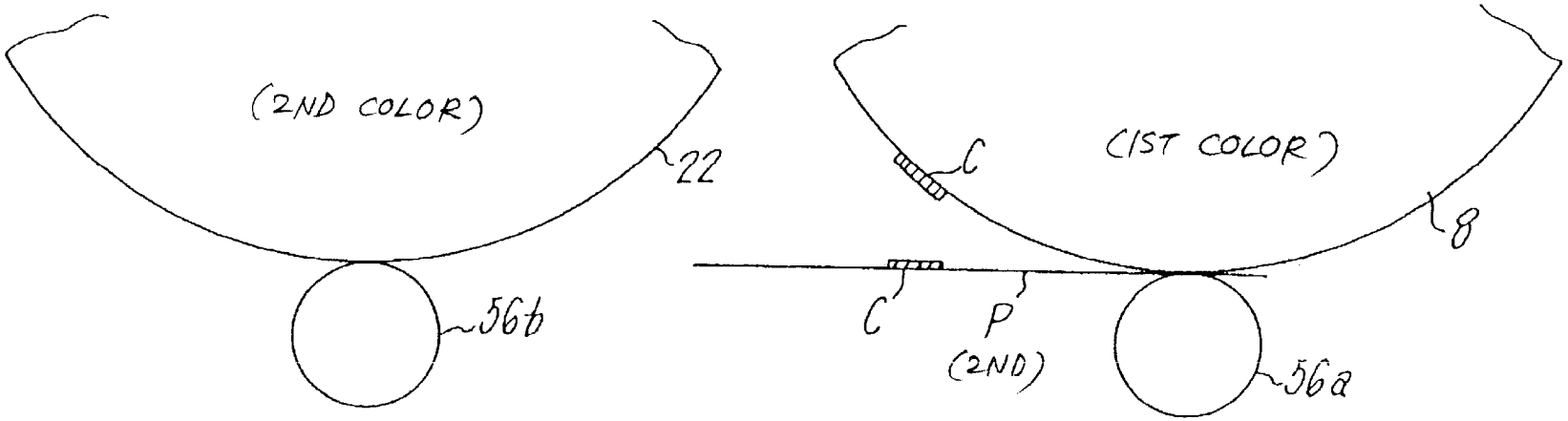
Figure 11:
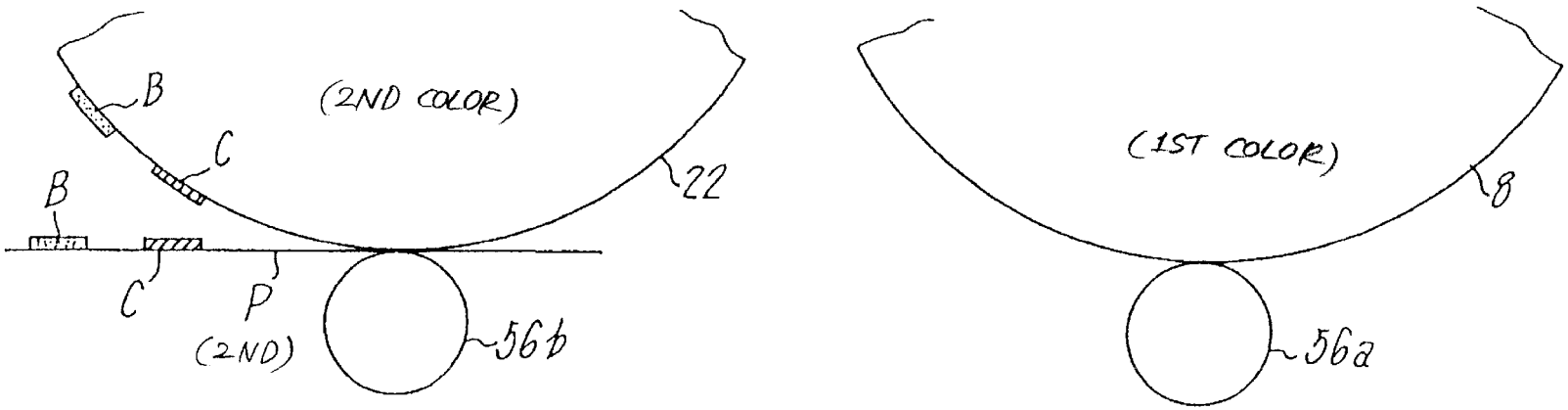

As shown in FIG. 10, an ink image C of the first color is transferred from the print drum 8 to the second paper sheet P in the same manner as the image C transferred to the first paper sheet P. As shown in FIG. 11, when the second paper sheet P is brought to the nip between the print drum 22 and the press roller 56*b*, the part of the image C previously transferred to the master 26 wrapped around the print drum 22 is retransferred to the paper sheet P over the image C existing on the paper sheet P. Because the image C existing on the paper sheet P has low density due to the unique pressure adjustment, the image C has density equal to the density of the image B at the end of the second printing cycle.

As stated above, in the illustrative embodiment, the pressure to act on the print drum 8 during printing is selected such that the density of the image C of the first color is equal to the density of the image B of the second color at the end of the printing cycle.

The illustrative embodiment uses the pressure adjusting means 62 to make the pressure to act on the print drum 8 lower than the pressure to act on the print drum 22. Alternatively, the spring 60 associated with the print drum 8 may be provided with a smaller spring constant than the spring 60 associated with the print drum 22, in which case both of the springs 60 will not be adjustable. However, the pressure adjusting means 62 is advantageous over the above alternative scheme in that it can compensate for the attenuation of the resiliency of the spring 60, i.e., a decrease in pressure due to aging without replacing the spring 60.

Figure 12:
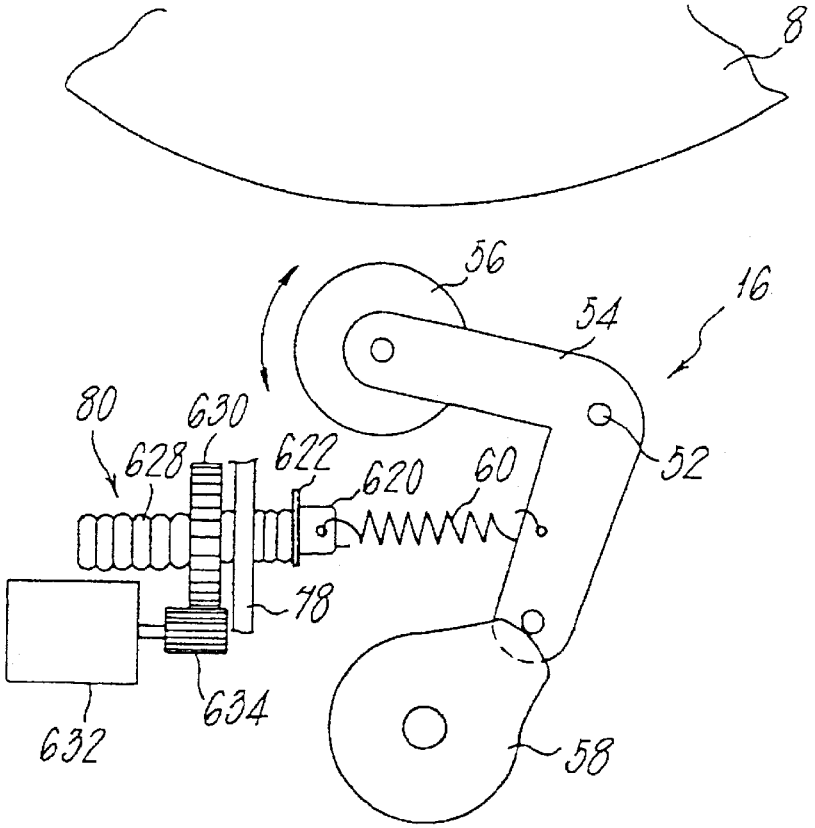
FIG. 12 is a front view showing pressing means representative of an alternative embodiment of the present invention.

An alternative embodiment of the present invention will be described with reference to FIGS. 12 through 14. While the previous embodiment allows an operator or a serviceman to adjust the pressure to act on the print drum 8 via the pressure adjusting means 62, the alternative embodiment to be described implements automatic pressure adjustment. In FIGS. 12 through 14, structural elements identical with the structural elements shown in FIG. 6 and 7 are designated by identical reference numerals and will not be described specifically in order to avoid redundancy.

As shown in FIG. 12, the illustrative embodiment includes pressure adjusting means 80 including the retaining portion 620 retaining one end of the spring 60. The stop portion 622 limits the amount of adjustment in the direction in which the spring 60 extends. A screw portion 628 is held in threaded engagement with the side wall 78 included in the printer body. A nut gear 630 is held in threaded engagement with the screw portion 628 and positioned by a bracket not shown. A stepping motor 632 has an output shaft on which a gear 634 is fixedly mounted. The gear 634 is held in mesh with the nut gear 630. The retaining portion 620, stop portion 622 and screw portion 628 are formed integrally with each other.

Figure 13A:
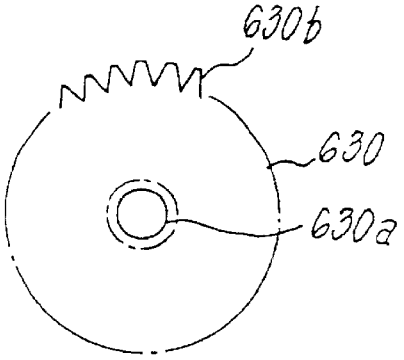
FIGS. 13A and 13B are respectively a side elevation and a section showing a nut gear included in pressure adjusting means included in the pressing means.
Figure 13B:
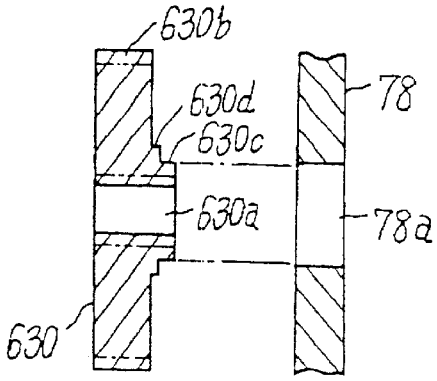
Figure 14:
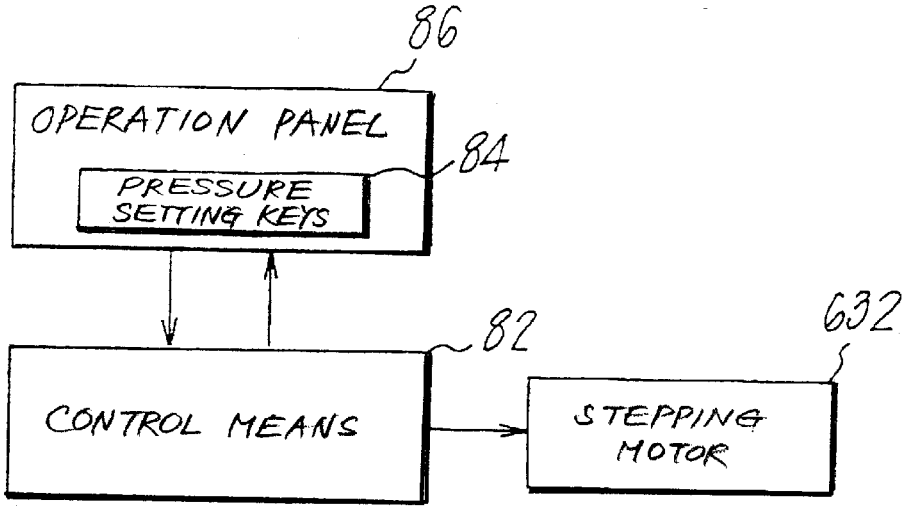
FIGS. 14 and 15 are block diagrams schematically showing control circuitry included in the alternative embodiment.

As shown in FIGS. 13A and 13B, the nut gear 630 has a threaded hole 630*a* mating with the screw portion 628 at its center and has a toothed surface meshing with the gear 634 on its outer circumference. Further, the nut gear 630 has a projection 630*c* received in a hole formed in the side wall 78 and a shoulder 630*d* forming a clearance between the nut gear 630 and the side wall 78.

FIG. 14 shows control circuitry included in the illustrative embodiment. As shown, control means 82 automatically adjusts the pressure to act on the print drum 8, FIG. 12. The control means is 82 is connected to the stepping motor 632 and an operation panel 86. The operation panel 86 includes pressure setting keys 84 playing the role of pressure setting means. The control means 82 is implemented by a microcomputer including a CPU (Central Processing Unit), a ROM (Read Only Memory) and an I/O (Input/Output) interface although not shown specifically. The control means

82 controls the stepping motor 632 in accordance with a pressure selected on the pressure setting keys 84. Multiple stepwise pressures are available with the illustrative embodiment.

More specifically, a home position sensor, not shown, is responsive to the home position of the screw portion 628. The control means 82 drives the stepping motor 632 in accordance with the output of the home position sensor as well as with the pressure selected. For example, when a density difference or the roll-up of a paper sheet occurs at a pressure selected, the operator or the serviceman sets a further lower pressure on the pressure setting keys 84. The control means 82 controls the stepping motor 632 on the basis of the newly set pressure.

Figure 15:
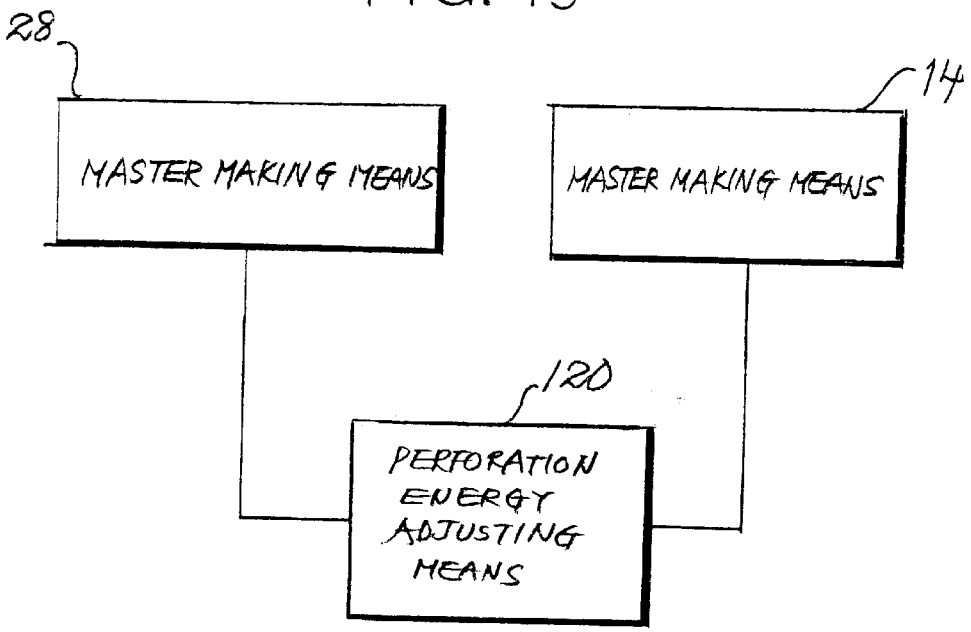

The automatic pressure adjustment described above easily realizes an optimal pressure that obviates a density difference and the roll-up of a paper sheet. Specifically, as shown in FIG. 15, perforation energy adjusting means 120 is connected to the master making means 14 and 28 for adjusting energy for perforating stencils. The perforation energy adjusting means 120 causes the master making means 28 to perforate a stencil with grater energy than the master making means 14.

In summary, it will be seen that the present invention provides a stencil printing method and a stencil printer therefor having various unprecedented advantages, as enumerated below.

(1) Ink is transferred from an upstream print drum to a paper sheet in a smaller amount than ink transferred from a downstream print drum to the same paper sheet. This obviates a density difference and the roll-up of a paper sheet ascribable to retransfer particular to a single pass, color printing system.

(2) Pressure adjusting means allows a low pressure to be selected, so that an optimal pressure can be set without replacing any member.

(3) The pressure adjusting means cooperates with control means to easily set the optimal pressure without resorting to time- and labor-consuming work. This is also successful to reduce the amount of ink transfer from the upstream print drum to a paper sheet.

(4) A particular perforation diameter is assigned to each of the upstream drum and downstream drum, so that the amount of ink transfer from the upstream drum to a paper sheet can be reduced without resorting to any additional mechanism.

Various modifications will become possible for those skilled in the art after receiving the teachings of the present disclosure without departing from the scope thereof.

What is claimed is:

1. A stencil printer for printing a color image on a paper sheet by passing said paper sheet only once therethrough, said stencil printer comprising:

a plurality of print drums each having a respective master wrapped therearound and spaced from each other in a direction of paper conveyance; and ink transfer adjusting means causing ink to be transferred from an upstream print drum, in the direction of paper conveyance, to the paper sheet in a smaller amount than ink transferred from a downstream print drum to said paper sheet such that a density of an ink image resulted from said upstream print drum is equal to a density of an ink image transferred from said downstream print drum to said paper sheet at an end of a printing cycle.

2. A stencil printer as claimed in claim 1, wherein a pressure to act on said upstream print drum during printing is selected to be lower than a pressure to act on said downstream print drum.

3. A stencil printer as claimed in claim 1, further comprising pressure adjusting means for adjusting a pressure to act on said upstream print drum during printing such that said pressure is lower than a pressure to act on said downstream print drum.

4. A stencil printer as claimed in claim 3, further comprising pressure setting means for allowing a desired pressure to be set, and control means for controlling said pressure adjusting means on the basis of the desired pressure.

5. A stencil printer as claimed in claim 1, wherein the master wrapped around said downstream print drum is perforated with a greater perforation diameter than the master wrapped around said upstream print drum.

* * * * *

UNITED STATES PATENT AND TRADEMARK OFFICE

CERTIFICATE OF CORRECTION

PATENT NO. : 6,581,515 B1
DATED : June 24, 2003
INVENTOR(S) : Daisuke Hasebe

It is certified that error appears in the above-identified patent and that said Letters Patent is hereby corrected as shown below:

Column 4,
Line 48, change “the master damper” to -- the master clamper --

Column 5,
Line 10, change “the master damper” to -- the master clamper --

Signed and Sealed this

Twenty-fourth Day of February, 2004

JON W. DUDAS
*Acting Director of the United States Patent and Trademark Office*